United States Patent [19]

Kimura et al.

[11] 4,423,948

[45] Jan. 3, 1984

[54] DUAL COMPONENT DEVELOPING MATERIAL DETECTING DEVICE FOR ELECTROSTATIC COPYING APPARATUS

[75] Inventors: Hiroshi Kimura, Neyagawa; Masahiko Hisajima, Osaka; Yutaka Shigemura, Takarazuka; Isao Yada, Neyagawa; Yoichiro Irie, Suita; Kiyoshi Morimoto, Osaka, all of Japan

[73] Assignee: Mita Industrial Company Limited, Osaka, Japan

[21] Appl. No.: 284,563

[22] Filed: Jul. 17, 1981

[30] Foreign Application Priority Data

Jul. 23, 1980 [JP] Japan ..... 55-101771

[51] Int. Cl.[3] ..... G03G 15/06

[52] U.S. Cl. ..... 355/14 D; 118/689; 355/3 DD

[58] Field of Search ..... 355/3 R, 3 DD, 14 D; 118/689, 690; 222/DIG. 1

[56] References Cited

U.S. PATENT DOCUMENTS

| | | | |
|---|---|---|---|
| 3,698,926 | 10/1972 | Furuichi | 118/689 X |
| 3,970,036 | 7/1976 | Baer et al. . | |
| 3,999,687 | 12/1976 | Baer et al. | 222/DIG. 1 X |
| 4,032,227 | 6/1977 | Hubbard et al. . | |
| 4,141,645 | 2/1979 | Reid et al. . | |
| 4,200,665 | 4/1980 | Suzuki et al. . | |
| 4,226,525 | 10/1980 | Sakamoto et al. | 355/14 D |
| 4,277,549 | 7/1981 | Tatsumi et al. | 355/14 D X |
| 4,332,467 | 6/1982 | Kimura et al. | 355/3 DD X |

*Primary Examiner*—Fred L. Braun

*Attorney, Agent, or Firm*—Wenderoth, Lind & Ponack

[57] ABSTRACT

A detecting device for detecting when the amount of toner in a dual component developing material is less than a predetermined level includes a hopper for supplying the toner, a stirring roller for stirring a carrier and the toner from the hopper, and a detector for detecting the amount of developing material provided near the stirring roller to mix the toner supplied from the hopper with the carrier. A discriminator discriminates an output signal from the detector for a predetermined interval during the rotational period of the stirring roller. An indicating element operates in response to the output signal from the discriminator to indicate when the amount of the toner in the developing material is less than the predetermined level. Since it is indicated when the toner in the developing material is less than the predetermined level, the toner is supplied according to such indication, and therefore, an undesirable deterioration of copy density is prevented.

1 Claim, 5 Drawing Figures

DUAL COMPONENT DEVELOPING MATERIAL DETECTING DEVICE FOR ELECTROSTATIC COPYING APPARATUS

BACKGROUND OF THE INVENTION

1. Field of the Invention

The present invention relates to a dual component developing material detecting device for use in an electrostatic copying apparatus.

2. Description of the Prior Art

In an electrostatic copying apparatus employing dual component developing material, it is required that the amount of consumed toner is supplied gradually to be mixed with a carrier in order to maintain a desired copy density. Conventionally, when the copy density is reduced, the toner is supplied in a hopper with the apparatus housing opened. Such procedure requires bothersome work, and it is difficult to maintain desired copy density.

It is an object of this invention to provide an electrostatic copying apparatus including a detecting device which does not require bothersome work in supplying toner to maintain a desired copy density.

It is another object to provide a detecting device for detecting the amount of toner stored in a developing device which indicates when the amount of toner is less than a predetermined level required to maintain the desired copy density.

SUMMARY OF THE INVENTION

To accomplish the foregoing objectives, there is provided a detecting device for detecting the amount of toner in a dual component developing material in a developing device and for indicating when the amount of toner is less than a predetermined level. The detecting device comprises a hopper for supplying the toner, a stirring roller for stirring a carrier and the toner from the hopper, detecting means for detecting the amount of dual component developing material provided at a position near the stirring roller, discriminating means for discriminating the output signal from the detecting means for a predetermined interval during the rotational period of the stirring roller, and an indicating element operable in response to the output signal from the discriminating means for indicating when the amount of the toner in the dual component developing material is less than the predetermined level.

The detecting means mentioned above comprises a movable contact member mounted swingably, and which swings by contact with the flowing developing material, and a fixed contact member.

The discriminating means mentioned above comprises, a time constant circuit having a capacitor and a resistor connected in series, a switching element connected in parallel to the capacitor, a comparison circuit for controlling the switching element when the fixing contact member and movable contact member contact, a level discriminating circuit for discriminating the level of the output signal from the time constant circuit, a latch circuit operable in response to the output signal from a timer for storing the output signal from the level discriminating circuit, a timer for supplying the output signal to the latch circuit after every predetermined period T4 within the period of a copying operation T3 while the stirring roller is driven to rotate, and a driving means operable in response to the output signal from the latch circuit for driving the indicating element to operate during a time the latch circuit stores the output signal from the comparison circuit when the amount of the developing material is less than the predetermined level according to the discrimination level l1 of the comparison circuit.

According to the invention, it is indicated when the toner in the dual component developing material is reduced below the predetermined level, and the toner is supplied according to such indication. Therefore, undesirable deterioration of the copy density is prevented. The specific gravity of the toner in a dual component developing material is about 1/20 that of the carrier, and thus the volume of the toner is relatively large. Accordingly, by detecting the amount of the developing material that contacts with the detecting means, the amount of consumed toner may be detected precisely, and thus the amount of residual toner is detected correctly.

BRIEF DESCRIPTION OF THE DRAWINGS

A detailed description of the invention will be made with reference to the accompanying drawings wherein like numerals designate corresponding parts in the figures.

DETAILED DESCRIPTION OF THE PREFERRED EMBODIMENT

The following detailed description is of the best presently contemplated mode of carrying out the invention. This description is not to be taken in a limiting sense, but is merely for the purpose of illustrating the general principles of the invention since the scope of the invention is best defined by the appended claims.

The present invention relates to a dual component developing material detecting device for use with an electrostatic copying apparatus and which indicates whether or not the toner of a dual component developing material has been reduced to a predetermined level.

Figure 1:
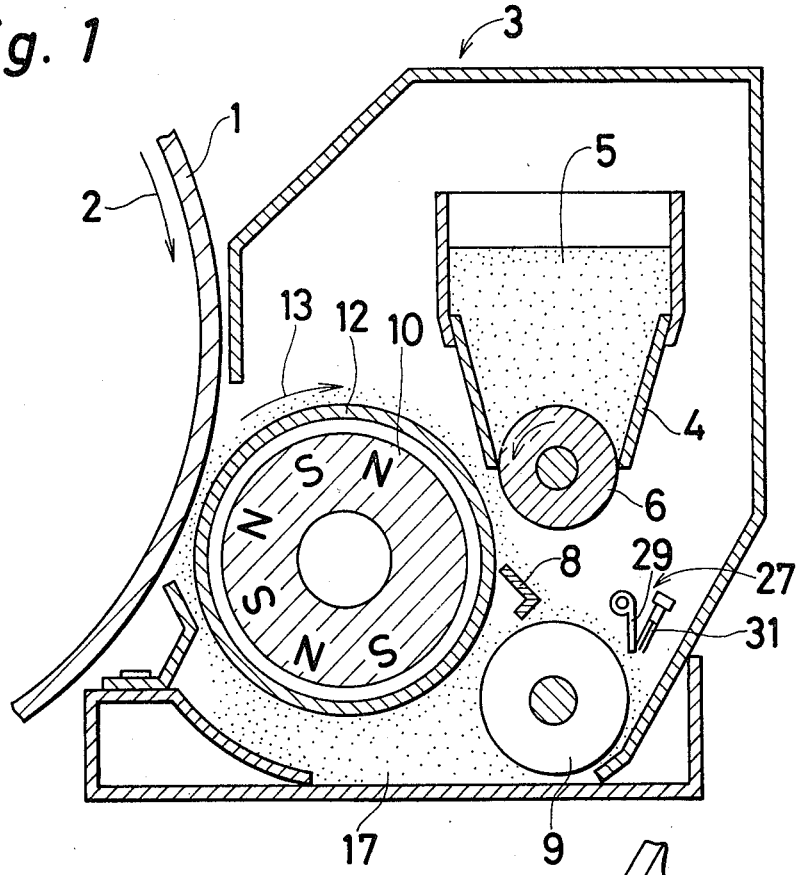
FIG. 1 is a vertical section of an embodiment of the present invention.

FIG. 1 is a sectional view of a developing device 3 according to an aspect of the invention. According to the movement of the optical system or the original document carrier, an electrostatic image corresponding to the original document is formed on the surface of a photosensitive drum 1 and slit exposure is accomplished. When the photosensitive drum 1 rotates in the direction of an arrow 2, toner is attached to the photosensitive drum 1 by the developing device 3 and the electrostatic image is developed to form a toner image. After this developing operation, the toner image is transferred to a copy paper, then the toner image on the copy paper is fixed, and a single copying operation is completed. In the developing device 3, the toner 5 is stored in a hopper 4. The toner 5 from the hopper 4 is supplied downward through a guide member 8 when a toner supplying roller 6 rotates. A stirring roller 9 is mounted in a sump 17. The stirring roller 9 is driven to rotate only when a portion of the optical system in the exposure device or an original document carrier is moved for exposure.

A permanent magnet bar 10 which circumferentially has a plurality of a alternate magnet poles in the rotative direction extends through a developing sleeve 12 made of non-magnetic material. The permanent magnet bar 10 is fixed to the copying apparatus housing. With the rotation of the developing sleeve 12 in the direction of arrow 13, the developing material in the sump 17 composed of a carrier and the toner moves in the rotational direction of the arrow 13, and the electrostatic image on the photosensitive drum 1 is developed by a magnetic brush on the developing sleeve 12. The carrier on the developing sleeve 12 which was used for development is removed by the guide member 8 and moves to the stirring roller 9 to be mixed again with the toner from the hopper 4. The toner supplying roller 6, the stirring roller 9, the permanent magnet bar 10 and the developing sleeve 12 extend parallel to each other along approximately the entire length of the photosensitive drum 1. A detecting device 27 for detecting the amount of flowing developing material is provided to extend axially near the center of the stirring roller 9.

Figure 2:
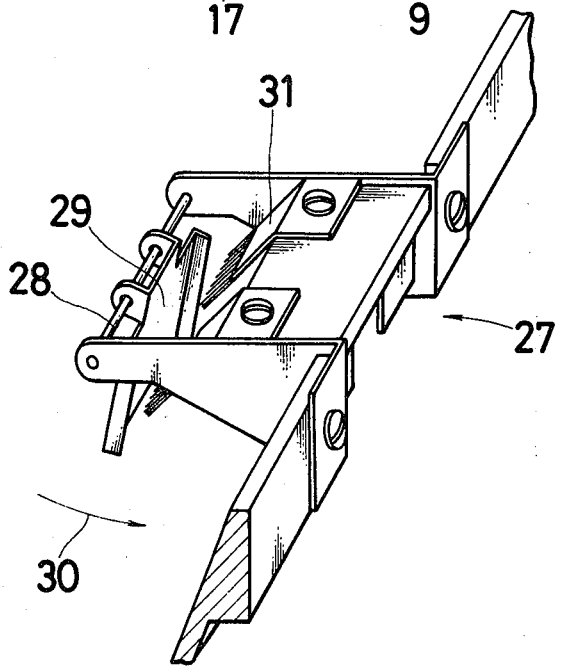
FIG. 2 is a perspective view illustrating a movable contact member and a fixed contact member.

FIG. 2 is a perspective view of the detecting device 27. A movable contact member 29 is mounted swingably to a pin 28 which is parallel to the axis of the stirring roller 9. Owing to the rotation of the stirring roller 9, the developing material flows thereby, and the movable contact member 29 swings around the pin 28 in the direction of the arrow represented in FIG. 2, thus causing the movable contact member 29 to contact with the brush-shaped fixed contact member 31. The movable contact member 29 and fixed contact member 31 are both electrically insulated from the housing of the electrostatic copying apparatus. Because the tip of the fixed contact member 31 is brush-shaped, it can contact with movable contact member 29 at a plurality of points, and performs a precise detection of whether the fixed contact member 31 contacts with the movable contact member 29.

Figure 3:
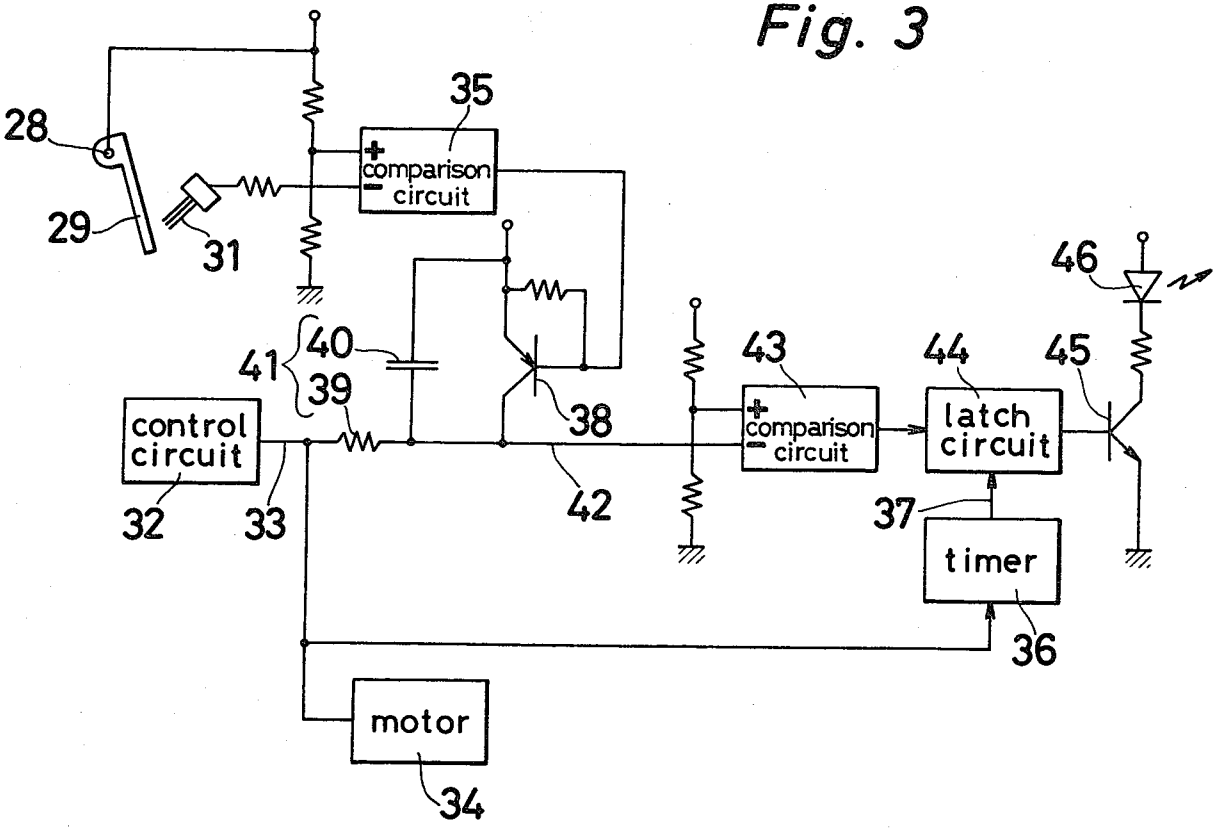
FIG. 3 is an electric circuit diagram relating to the operation of the movable contact member and the fixed contact member.

FIG. 3 is an electric circuit diagram relating to the movable contact member 29 and fixed contact member 31 for the electrostatic copying apparatus of the present invention. When the portion of the optical system or the original document carrier is moved, a control circuit 32 provides a low level signal to a line 33, and a main motor 34 is driven which allows the portion of the optical system or the original document carrier to move. By the motor 34 being driven the stirring roller 9 is also driven to rotate as mentioned above. During the time that a copying operation is not being performed, the main 34 is not driven, and the line 33 is maintained at a high level.

Figure 4:
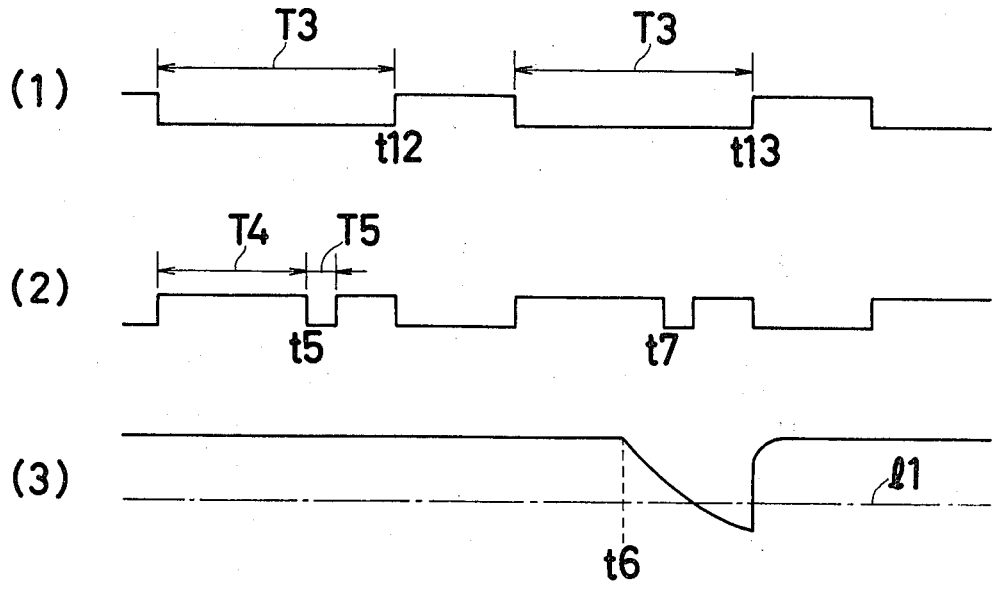
FIG. 4 and FIG. 5 are wave form diagrams that explain the operation of the electric circuit diagram of FIG. 3.

Referring to FIG. 4 (1) which shows the signal wave form of line 33, the main motor 34 is driven to rotate and the exposure step is carried out during the period T3, when the signal is maintained low level. A timer 36 in response to the signal from the control circuit 32 through the line 33, provides an output signal having the wave form represented in FIG. 4 (2) to a line 37. In response to the output signal from the control circuit 32, and when the line 33 becomes low level, the timer 36 provides a high level signal to the line 37 during a predetermined period T4 ($T4<T3$), and then provides a low level signal during a period T5 which is shorter than T4. Thus, the timer 36 provides an output signal having a periodical wave form and maintains the line 37 at low level when the line 33 is high level.

When a desirable copy density is achieved by supplying the toner 5 sufficiently to the sump 17 from the hopper 4, the movable contact member 29 contacts with the fixed contact member 31 because of the flow of the developing material by the rotation of the stirring roller 9. Therefore, the fixed contact member 31 becomes high level, and thus the output from a comparison circuit 35 becomes low level. Therefore a transistor 38 turns on. Related to the transistor 38, a time constant circuit 41 composed of a resistance 39 connected series to the line 33 and a capacitor 40, one of the terminals of which is connected to the line 33, is provided. Turning on the transistor 38 maintains a line 42 to be high level, and thus the output from a comparison circuit 43 remains low level. The wave form of the line 42 is represented in FIG. 4 (3). A latch circuit 44 reads in and stores the output signal from the comparison circuit 43 to maintain a transistor 45 off at t5 when the output from the timer 36 through the line 37 is low level. Therefore, a luminescent diode 46 is maintained off.

As the line 33 turns to be high level at t12 and t13 represented in FIG. 4 (1), the main motor 34 stops and the rotation of the stirring roller 9 is stopped. Therefore, the developing material does not flow, and the movable contact member 29 swings back around the pin 28 in a direction opposite to the direction indicated by the arrow 30 and separates from the fixed contact member 31. Accordingly, the output signal from the comparison circuit 35 becomes high level, and the transistor 38 turns off. Thus, the line 42 becomes high level.

When the developing material is sufficiently contained in the sump 17, the voltage drop of the line 42 by the capacitor 40 is controlled so as to drop gently after t6 represented in FIG. 4 (3) by means of setting the time constant of the time constant circuit 41 at a large value, even if the movable contact member 29 separates from the fixed contact member 31 for a short time and thus the transistor 38 is off for a short time. Therefore, the signal level of the line 42 at t7 is higher than the discrimination level l1 of the comparison circuit 43. Accordingly, as the transistor 45 remains off, the luminescent diode 46 remains off.

When a portion of the optical system or the original document carrier is not moved, the stirring roller 9 also stops rotating, and the movable contact member 29 may contact with the fixed contact member 31 or may separate from the fixed contact member 31. The construction is such that the contact member 29 contacts with the fixed contact member 31 when the stirring roller 9 rotates, i.e. the exposing period, under the condition that a sufficient amount of developing material is contained in the sump 17.

Figure 5:
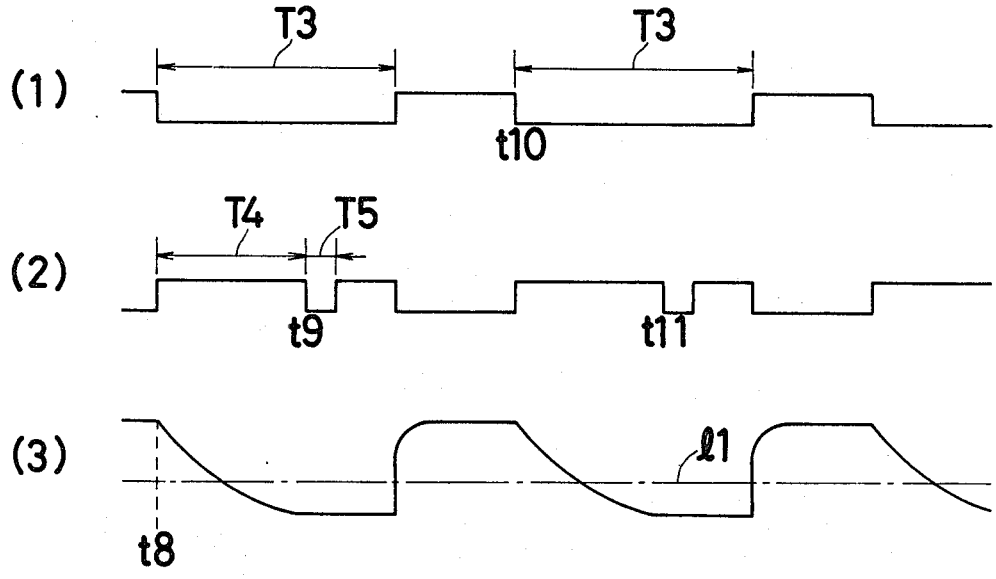

Referring to FIG. 5, assume that a small amount of developing material is contained in the sump 17 after the toner is reduced. FIG. 5 (1) and FIG. 5 (2) show the wave forms of the lines 33 and 37 and are identical with FIG. 4 (1) and FIG. 4 (2), respectively. Assume that the movable contact member 29 separates from the fixed contact member 31 at t8 in FIG. 5 (3) during which the stirring roller 9 rotates. In this case, the output signal from the comparison circuit 35 becomes high level, and the transistor 38 turns off. Therefore, the voltage of the line 42 gradually drops after t8 to show the wave form represented in FIG. 5 (3) because the line 33 is low level. The latch circuit 44 reads in the high level output signal from the comparison circuit 43 to turn on the transistor 45 at t9 when the signal level of the line 42 drops to a level lower than the discrimination level l1 of the comparison circuit 43. Therefore, the luminescent diode 46 turns on.

When a small amount of developing material is contained in the sump 17, the movable contact member 29 does not swing and remains separated from the fixed contact member 31. Accordingly, as soon as the line 33 becomes low level at t10 in FIG. 5 (1), the signal level of the line 42 begins to drop from the high level by means of the time constant circuit 41. Therefore, the signal level of the line 42 is below the discrimination level l1 of the comparison circuit 43 at t11 in FIG. 5 (2). Thus, the luminescent diode 46 is turned on, in the same process.

The discrimination level l1 of the comparison circuit 43 corresponds to the ratio of the toner to the carrier in the sump 17. When it is desired that the ratio of the toner to the carrier is set at a predetermined higher level, the discrimination level l1 is set at a large value corresponding to the ratio of the toner to the carrier.

In another aspect of the invention, the movable contact member 29 and the fixed contact member 31 may be replaced by a mechanism having an oscillation circuit, composed of an oscillation coil around a magnetic core, and a counter which discriminates the frequency or the pulse from the oscillation circuit to provide the output signal to one of the lines of a comparison circuit 35 as an input, because the carrier itself has magnetism. The construction should be considered to be included within the scope of claims.

What is claimed is:

1. An apparatus for use in an electrostatic copying apparatus for monitoring the concentration of toner in a developer having a mixture of toner and carrier particles, said apparatus comprising:

a hopper for supplying toner;

a stirring roller rotatable for stirring a carrier and the toner supplied from said hopper;

detecting means for detecting the amount of the developer at a position adjacent said stirring roller, said detecting means comprising a fixed contact member and a movable contact member;

discriminating means for discriminating an output signal from said detecting means for a predetermined interval during a period of rotation of said stirring roller, said discriminating means comprising a time constant circuit including a capacitor and a resistor connected in series, a switching element connected in parallel with said capacitor, a first comparison circuit for controlling said switching element when said fixed contact member and said movable contact member contact each other, a second comparison circuit for determining whether the level of an output from said time constant circuit is greater than a predetermined level, a timer for supplying an output signal after every said predetermined interval during a copying operation while said stirring roller is rotated, and a latch circuit operable in response to said output signal from said timer for storing a discriminated signal from said second comparison circuit;

indicating means operable in response to an output signal from said discriminating means for indicating when the amount of said toner in the developer is less than a predetermined amount; and said discriminating means further comprising driving means, operable in response to the output signal from said latch circuit, for operating said indicating means during a time period when said latch circuit stores said discriminated signal from said second comparison circuit.

* * * * *